United States Patent [19]

Krasik

[11] Patent Number: 4,707,575

[45] Date of Patent: Nov. 17, 1987

[54] SPRING SWITCH FOR ELECTRONIC CIRCUITS

[76] Inventor: Michael H. Krasik, 1849 North 53rd St., Seattle, Wash. 98103

[21] Appl. No.: 900,503

[22] Filed: Aug. 26, 1986

[51] Int. Cl.[4] ..... H01H 1/06; H01H 35/00

[52] U.S. Cl. ..... 200/52 R; 200/276

[58] Field of Search ..... 200/16 R, 61.76–61.79, 200/61.64, 61.93, 276, 52 R

[56] References Cited

U.S. PATENT DOCUMENTS

| | | | |
|---|---|---|---|
| 3,691,331 | 9/1972 | Resh | 200/276 X |
| 4,028,515 | 6/1977 | Desio et al. | 200/276 |
| 4,264,792 | 4/1981 | Gillette | 200/276 X |

FOREIGN PATENT DOCUMENTS

| | | | |
|---|---|---|---|
| 2340791 | 2/1975 | Fed. Rep. of Germany | 200/276 |
| 135864 | 12/1929 | Switzerland | 200/276 |
| 829965 | 3/1960 | United Kingdom | 200/276 |

*Primary Examiner*—J. R. Scott

*Attorney, Agent, or Firm*—Seed and Berry

[57] ABSTRACT

A spring switch for electronic circuits and a method for making same are disclosed. The spring switch employs a coil spring having a helical wind of a plurality of coil turns. The diameter of the coil spring is selected to receive, between two adjacent coil turns, two legs of a dual in-line packaged, integrated circuit. The integrated circuit is mounted, top down, on a plate which has an electrically conductive surface. An electrical circuit having two open circuit terminals has one terminal connected to the electrically conductive surface. The second open circuit terminal is electrically connected to the electrically conductive coil spring. A cam mechanism depresses a free end of the coil spring and wipes the free end against the electrically conductive surface to complete the circuit.

2 Claims, 7 Drawing Figures

SPRING SWITCH FOR ELECTRONIC CIRCUITS

DESCRIPTION

1. Technical Field

This invention relates to switches for electronic circuits and a method for making the same. More specifically, the invention relates to low-cost switches for use in low-clearance applications and methods for efficiently manufacturing and assembling switches and electronic circuits.

2. Background Art

A variety for switches for electronic circuits are presently available. In certain applications, it is desirable to use switches which occupy little space and which have high mechanical contact surface integrity.

It is also known that for certain applications, switches which are actuated by keys are particularly desirable. However, a number of disadvantages are associated with such switches. One particular disadvantage is the relatively high cost of key-actuated electronic switches. Typically, such switches can cost on the order of a few dollars or more. Thus, while the key-operated switch provides desirable security for certain applications, it is not economically feasible to supply low-cost electrical circuits with key-operated switches. A further disadvantage of typical key-operated switches is that such switches often have a depth, measured along the longitudinal axis of the switch, of approximately one inch or more. Thus, conventional self-contained key switches cannot be readily adapted into circuits which must be housed in relatively low-clearance housings.

In order to overcome the above-described disadvantages of key-operated switches, it is possible to use a conventional microswitch, actuated by a shortbarreled, key-operated lock to complete circuits which are contained in low-clearance environments. Microswitches typically employ a switch body having electrical contacts and an extending actuating arm which is pivoted about an axis external to the switch body. A portion of the arm is positioned to depress a button which establishes electrical continuity between contacts when the arm is depressed by an external rotating cam.

While the cost of such microswitches is on the order of approximately one dollar, and therefore less than the cost of self-contained, key-actuated switches, a number of other disadvantages are associated with this type of switch. The microswitch body must be accurately positioned relative to the actuating cam to assure that the actuating cam fully depresses the external arm on the microswitch. Such precise positioning is undesirable during assembly of the circuit including the switch. Furthermore, the actuating arm which extends from the microswitch body is relatively delicate. If, for any reason, the actuating cam is over-rotated beyond the end of the arm, and then counter-rotated to reset the seitch, the external arm might be damaged. Further yet, as with the self-contained, key-operated switch discussed above, external terminals on the microswitch body are typically connected to other components of the circuits with insulated wire, which requires an additional soldering step.

Thus, a need exists for a switch for low-clearance electrical circuit applications which is relatively inexpensive, which is easily assembled as an integral part of the electronic circuit, and which is damage-resistant. Furthermore, the ideal switch would have improved reliability over key-operated switches and microswitches which are presently available.

3. Disclosure of the Invention

It is an object of the present invention to provide a low-clearance, key-operated switch which is inexpensive to manufacture, and which forms an integral part of the electronic circuit.

It is another object of the present invention to provide a switch for electronic circuits which is damage-resistant.

It is yet another object of the present invention to provide a switch for electronic circuits which has high mechanical contact surface integrity.

These objects, and other objects and advantages which will be apparent from the description which follows, are achieved by using an electrically conductive coil spring which is supported above an electrically conductive surface. The coil spring has a rest position which maintains the spring separated from the electrically conductive surface. A mechanism is provided which selectively wipes a portion of the coil spring against and contacts the spring portion with the electrically conductive surface to establish electrical continuity therebetween. An electrical circuit having two open circuit terminals can have one of the open circuit terminals electrically connected to the spring and the remaining open circuit terminal electrically connected to the electrically conductive surface so that continuity established between the spring and surface closes the circuit. Multiple pole applications are also possible.

In the preferred embodiment, the mechanism for moving the spring portion is a rotating cam which has a convexly curved surface to slightly compress and substantially translate the spring portion across the electrically conductive surface. This inherently simple mechanical structure causes the spring to have a high mechanical reliablity and a self-cleaning and wiping action against the electrically conductive surface. The cam is rotated by a key-operated lock having a relatively short cylinder housing mounted to the mounting plate. The cylinder housing has a cylinder which is rotated by operation of the key and which is connected to the cam for rotation therewith. Thus, operation of the key rotates the cam, which either opens or closes the circuit. Because the spring is resilient in all off-axis directions, over-rotation of the cam followed by reverse rotation will not mechanically disable the switch. The cam can merely be rotated back into the original position and the spring will resiliently disengage the cam and reset to its original rest position.

One end of the spring can be provided with a tangential stop arm which extends from the last coil on the supported end of the spring. The diameter of the supported end of the spring can be selected to be larger than the spacing between the legs of a dual in-line packaged (DIP), integrated circuit (IC). The spring can be easily positioned on two legs of the DIP integrated circuit by positioning two adjacent IC legs between the tangential stop arm and the adjacent last coil turn on the spring. By then rotating the coil spring in the direction of the spring helix, the legs automatically become positioned in-between two adjacent coil turns and the tangential stop arm abuts against the body of the dual in-line package. The legs are then ready to be electrically connected, such as by soldering to the spring.

The spring switch is particularly suited for use in a simulated alarm system having a relatively shallow mounting plate in which an electronic flasher circuit is contained. A relatively low-clearance key-operated cam is mounted to the plate, and a DIP integrated circuit having a coil spring assembled as described above is mounted to the inside of the switch plate. Batteries can be positioned within the housing and are grounded to the switch plate. The positive terminal of the batteries can be connected to the DIP flasher integrated circuit, which operates a light-emitting diode. The light-emitting diode penetrates through the switch plate. Rotation of the key causes the cam to contact a portion of the spring against the switch plate, thus establishing electrical continuity in the circuit and operating the light-emitting diode. Because the circuit elements can be mounted directly to the switch plate without a printed circuit board, manufacturing costs are substantially reduced. Furthermore, placement of the spring/integrated circuit assembly is not highly critical for proper positioning of the portion of the spring which interacts with the cam, thus further reducing production costs. The entire circuit can be easily contained in a switch plate having a depth of approximately one-half inch or less, which simulates the functional appearance of real alarm system switch plates.

BEST MODE FOR CARRYING OUT THE INVENTION

Figure 1:
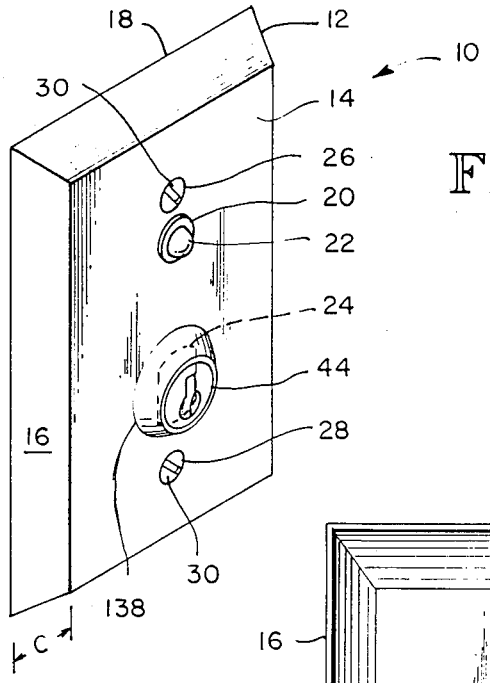
FIG. 1 is an isometric view of a simulated alarm system having an electrical circuit which employs the switch of the present invention as an integral part thereof.

A simulated alarm system, utilizing the switch of the present invention, is generally indicated at reference numeral 10. The simulated alarm system has a stainless steel mounting plate 12 having a face plate 14 and peripheral sidewalls 16, 18 which are connected to the face plate 14 at an angle so as to give the mounting plate 12 a depth d of approximately one-half inch.

Figure 7:
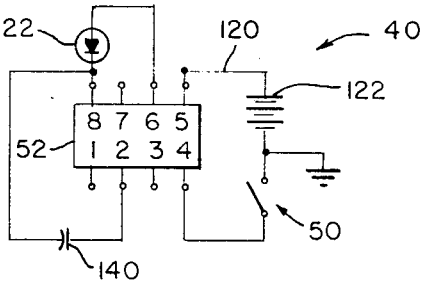
FIG. 7 is an electrical schematic of the simulated alarm system shown in FIGS. 1 and 2.

The face plate 14 has an LED aperture 20 which receives an LED 22. The face plate also has a D or double D-shaped aperture 24 which receives a key lock cylinder housing 26, best seen in FIG. 2, for preventing rotation of the cylinder housing relative to the mounting plate 12. The face plate also has fastener apertures 28 for threaded fasteners 30 for fastening the simulated alarm system 10 to a door frame or other external structure. The simulated alarm system has a flasher circuit, generally indicated at reference numeral 40, which causes the LED 22 to blink in a fashion similar to that of some conventional alarm systems when a key (not shown) is inserted in a lock cylinder 44, which is rotatably mounted in the key lock cylinder housing 26, and rotated. A schematic of electronic flasher circuit 40 is shown in FIG. 7.

Figure 3:
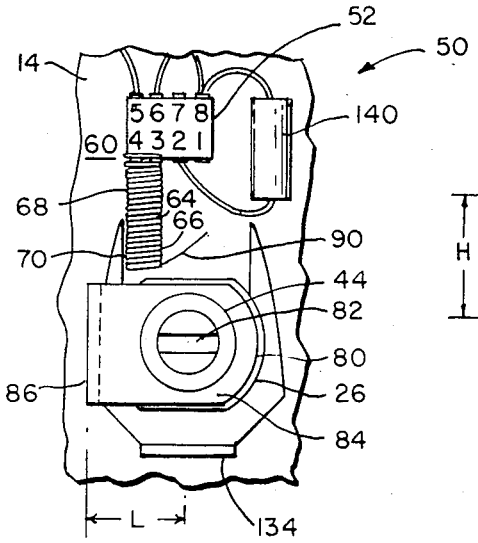
FIG. 3 is an enlarged fragmentary view of the cam mechanism and integrated circuit/spring combination shown in FIG. 2.
Figure 4:
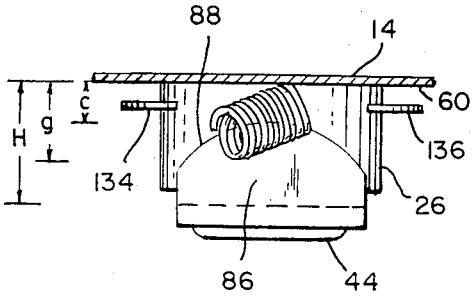
FIG. 4 is an enlarged sectional elevational view taken generally along line 4—4 of FIG. 2.

In order to dissuade unauthorized persons from entering a dwelling or other building displaying the simulated alarm system 10, it is imperative that the simulated alarm system simulate the mechanial appearance of a generic class of alarm system mounting plates. It has been found that the depth d of the mounting plate 12 should not exceed approximately one-half inch in order for the illusion to be successfully conveyed. Thus, it is not possible to use prior art self-contained key switches which have depths in excess of approximately one inch. For this reason, and other reasons which will be more fully described below, the electronic flasher circuit 40 is supplied with an integral spring switch 50, which is best shown in FIG. 3.

The integral spring switch 50 includes a dual in-line package (DIP), integrated circuit (IC) 52 which is an LM3909 LED flasher/oscillator manufactured by National Semiconductor Corporation. The integrated circuit 52 is shown mounted topside-down to the inside surface 60 of the face plate 14. The manufacturer's pin numbers are shown designated as numbers 1 through 8 on the integrated circuit 52.

The integrated circuit 52 forms an electrically insulative support for an electrically conductive coil spring 64. The coil spring has a plurality of adjacent turns 66 which form a cylindrical helix. A fixed end 68 of the coil spring 64 is electrically and physically connected to pins 4 and 3 of the integrated circuit 52 by a method which will be more fully described below.

The fixed end 68 is electrically insulated from the electrically conductive inside surface 60 of the face plate 14 by the body of the dual in-line package of the integrated circuit 52. The axis of the coil spring is maintained in a substantially parallel relationship to the electrically conductive inside surface 60 by the DIP body 52 so that an air gap is formed between the surface and the exterior of the spring. The coil spring 64 is preferably manufactured from 0.015 inch diameter music wire which is zinc plated for oxidation resistance. Other platings or spring materials may be used, depending on the desired electrical and mechanical characteristics of the switch contact area which is more fully described below. It has been found that stainless steel is a suitable substitute material for this purpose. If stainless steel is used, it is preferred to spot-weld the connection.

Figure 2:
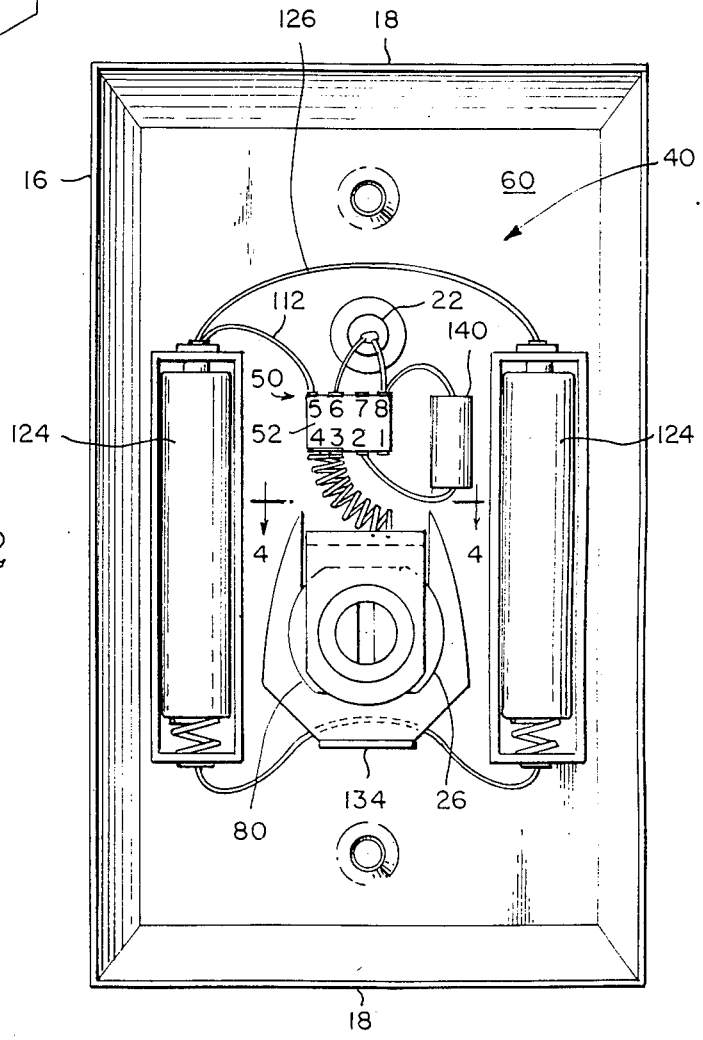
FIG. 2 is a rear elevational view of the simulated alarm system shown in FIG. 1.

The coil spring 64 has a free end 70 which is positioned so that rotation of a cam 80 about a cam axis 82 displaces the coil spring from the rest position, shown in FIG. 2, to a displaced position, shown in FIG. 2.

The cam 80 has a first portion 84 which is connected for rotation with the lock cylinder 44. One end of the first portion 84 has a second portion 86 which extends perpendicularly from the first portion and towards the electrically conductive inside surface 60 of the face plate 14. The first portion has a length (see FIG. 3) L of approximately 0.500 inch between the cam axis 82 and the second portion 86. The second portion has a height H of approximately 0.250 inch. The depth of the key lock cylinder housing 26 and lock cylinder 44 from the face place 14 is less than one-half inch.

A suitable key lock having the required shallow depth is Model No. 344 FCQ manufactured by ESP Corp., Leominster, Mass. The first portion 84 of the cam 80 is substantially parallel to the face plate 14 so that the depth of the entire assembly is less the depth d of the mounting plate 12.

The second portion 86 of the cam 80 has a convexly curved cam surface 88 which is spaced from the electrically conductive inside surface 60 of the face plate 14 so as to provide a moderate compressive and relatively substantial translative force to the free end 70 of the coil spring 64. Rotation of the cam to the second position wipes the free end of the spring against the electrically conductive inside surface 60 and positions the free end thereagainst. This occurs when the lock cylinder 44 is rotated to position the cam 80, as shown in FIG. 2. The wiping action leaves a wear path 90 in the electrically conductive inside surface 60, which removes oxidation and other surface contaminants from the surface, which would otherwise decrease electrical conductivity between the coil spring 64 and the electrically conductive inside surface 60.

The coil spring 64 has an outside diameter of approximately 0.160 inch. The closest distance c between the electrically conductive inside surface 60 and the cam surface 88 is approximately 0.060 inch. The greatest distance g between the cam surface 88 and the electrically conductive inside surface 60 is approximately 0.300 inch. The radius of curvature of the cam surface 88 is approximately 11/32 inch.

It has been found that a cam surface having a separation distance and shape as described above sufficiently compresses the spring, without binding the spring against the electrically conductive inside surface 60, and translates the spring to provide the desired wiping and contacting action as described above.

If the closest distance c between the cam surface and the electrically conductive inside surface 60 is too small, then the spring will be insufficiently compressed to provide the wiping action. If the closest distance c is too large, the spring will jam under the rotating cam or miss the cam altogether. If the greatest distance g is too small, then the spring will be excessively translated and insufficiently compressed for good contact. Thus, when increasing or decreasing the scale of the present invention, it is desirable to approximately maintain the above-described relationships to provide the correct wiping action and contact pressure.

Figure 5:
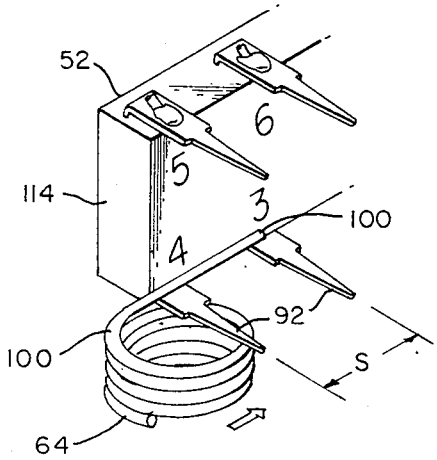
FIG. 5 is an enlarged isometric view of a first assembly step of the present invention.
Figure 6:
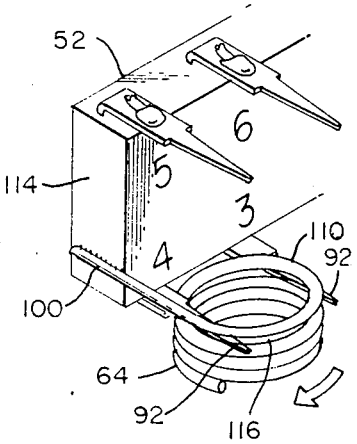
FIG. 6 is an enlarged isometric view of a final assembly step of the method shown in FIG. 5.

FIGS. 5 and 6 illustrate a preferred method for positioning and connecting the spring 64 to the legs 92 of the DIP integrated circuit 52. The typical separation distance s of legs on this dual in-line package is approximately 0.100 inch. The outside diameter of the coil spring 64 (0.160 inch) has been selected so that adjacent legs can be positioned between adjacent coil turns of the spring.

The coil spring 64 has a tangential stop arm 100 which extends from the last turn 110 on the fixed end 68 of the spring coil 64. In the application shown, the helix of the coil spring has a clockwise or "left-hand" curl for a purpose which will be more fully understood later.

To assemble the coil spring 64 with the DIP IC 52, the tangential stop arm 100 is first preferably positioned as shown in FIG. 5 so that the legs 92, corresponding to pins 4 and 3 of the DIP integrated circuit 52, are between the tangential stop arm 100 and the last coil turn 110 of the coil spring 64. The tangential stop arm is then preferably slid behind the pins by guiding the stop arm against the bottom 112 of the integrated circuit 52, as shown by the arrow in the figure.

As shown in FIG. 6, after the last coil turn 110 is seated against leg 92 of pin 4 by fully translating the coil spring 64 to the right, as shown by the arrow in FIG. 5, the coil spring is then rotated in the direction of the helix, i.e., clockwise, as shown by the arrows in FIG. 6, so that the tangential stop arm 100 abuts against a stop surface 114 formed by the side of the DIP integrated circuit 52.

It is observed that the legs 92 are now positioned between the last coil turn 110 and a next-to-last coil turn 116 on the fixed end 68 of the spring 64. The coil spring is automatically centered about the legs 92 so that the coil axis of the coil spring runs therebetween.

The tangential stop arm 100 may be bonded to the stop surface 114 by a suitable adhesive, such as cyanoacrylate or another suitable adhesive. The legs 92 can then be soldered to the fixed end of the coil to provide permanent electrical continuity therebetween.

It has been found that the above-described method for seating the coil spring 64 on an integrated circuit, such as DIP integrated circuit 52 permits precise and repeatable positioning of the coil spring on the IC. This method is extremely rapid and simple, even for unskilled laborers, and reduces the assembly cost of the spring switch 50.

It has also been found that the positioning of the resulting assembly on the electrically conductive inside surface 60 of the face plate 14 is not critical for proper operation of the switch, as is the case with conventional prior art microswitches. As long as the free end 70 of the spring extends, when in the rest position, beyond the arcuate path of the cam second portion 86, then good contact will be made between the free end 70 and electrically conductive inside surface 60. In this case, it has been found that by extending the free end 70 of the spring 64 approximately 0.075 inch beyond the arcuate path traveled by the cam second portion 86, sufficient contact can always be made.

Because the DIP integrated circuit 52 forms the support structure and insulating base for the spring 64, it is possible to directly mount the components of the electronic flasher circuit 40 directly to the electrically conductive inside surface 60 of the face plate 14. This technique eliminates the need for a printed circuit board and most external wiring, as will be more fully described.

Referring to FIG. 7, the electronic flasher circuit 40 includes a DIP integrated circuit 52, as has been previously discussed. Pin 5, the positive supply source pin of the integrated circuit, is connected by an insulated power wire 120 to the positive terminal of a battery supply 122. As shown in FIG. 2, two AAA batteries 124 are connected in parallel by an insulated jumper wire 126 to provide a battery life of up to two years for the simulated alarm system 10.

The fixed end 68 of the coil spring 64 is connected, as has been previously described, to pin 4 of the integrated circuit (which is the negative voltage supply) and pin 3 of the integrated circuit (which is an unconnected pin). Electrical continuity with the negative battery terminal 130 is provided by an uninsulated, nickelclad wire 132 which is held in compression against the electrically conductive inside surface 60 of the face plate 14 by a conventional D-clip 134. The D-clip is received by grooves 136 in the key lock cylinder housing 26. The D-clip has a curved shape which resiliently holds the key lock cylinder housing 26 between the face plate 14 and a dress nut 138, best seen in FIG. 1. The D-clip also provides electrical continuity between the negative battery terminal 130 and the electrically conductive inside surface 60 of the face plate 14 through the wire 132. Thus, rotation of the cam 80 to the position shown in FIG. 2 causes the free end 70 of the coil spring 64 to wipe against and positively contact the electrically conductive inside surface 60 and complete the circuit shown in FIG. 7.

In applications where it is desirable to insulate the user from the electrical circuit, a lock having a non-conductive cylinder housing should be used. Furthermore, the mounting plate 12 can be manufactured from a non-conductive material, such as plastic, and the portions of the inside surface 60 beneath the wear path 90 need be made conductive. Such a conductive portion can be provided by plating, etching or other processes which are well known to those skilled in the art.

The circuit also has a timing capacitor 140 having a value of approximately 100 microfarads connected directly between pins 2 and 8 without any insulated jumper wires between the capacitor and the respective pins. The capacitor is directly bonded to the electrically conductive inside surface 60 of the face plate 14 as a further step in reducing production costs. The LED 22 is connected between pins 8 and 6 as shown.

The above-described structure and method for assembling the spring switch provide an extremely compact, reliable and inexpensive switch and circuit structure for electronic circuits. Although the spring switch 50 has been described for operation with a simulated alarm system 10, it is to be understood that the spring switch 50 is adaptable to a variety of other applications. For example, it will be well appreciated by those skilled in the art that the spring switch 50 can be applied to any device which requires low clearance and low cost. In the preferred embodiment, the invention provides the security of a key switch with the low clearance of conventional prior art microswitches. Furthermore, the integral spring switch 50 of the present invention, in conjunction with the associated method of circuit assembly, can greatly reduce the cost of many circuits. Further yet, the spring switch assembly 50 can supplant expensive cam-actuated switches which employ conventional microswitches.

Therefore, the invention is not to be limited by the above description, but is to be determined in scope by the claims which follow.

I claim:

1. A low profile switch for electronic circuitry, comprising:

a mounting plate having an electrically conductive surface;

an electrically conductive coil spring defining a coil axis and having a plurality of closely spaced, helical coil turns, a fixed portion and a free portion, the free portion being movable between a rest position in which the coil axis is substantially linear and a displaced position in which the coil axis is non-linear;

a dual in-line packaged, integrated circuit having two legs electrically and physically connected to and supporting the coil spring fixed portion so that the coil spring free portion in the rest position is spaced apart from the conductive surface so as to form an air gap therebetween and a non-conductive package body for electrically insulating the coil spring fixed portion from the mounting plate electrically conductive surface;

means for selectively moving the coil spring free portion from the rest position to the displaced position and for wiping and contacting the coil spring free portion against the electrically conductive surface to establish electrical continuity therebetween; and an electronic circuit having a light source, means for intermittently energizing the light source and two open circuit terminals, one terminal electrically connected to the coil spring and the other terminal electrically connected to the conductive surface.

2. A method for positively positioning and electrically connecting a coil spring to a dual in-line packaged, integrated circuit wherein the dual in-line packaged, integrated circuit is of the type which has at least two substantially parallel, spaced-apart, conductive legs extending from a body portion, comprising the following steps:

providing an electrically conductive helical coil spring having two ends, a plurality of adjacent coil turns and, at one end, having a substantially constant coil diameter larger than the space between the integrated circuit legs and also having a tangential stop arm extension of the last coil turn on the end;

positioning the two legs in a plane between the tangential stop arm extension and the last coil turn on the end;

rotating the coil in the helix direction to position the tangential stop arm against the body and the legs between adjacent coil turns; and forming a permanent physical and electrical connection between the legs and the adjacent coil turns.

* * * * *